United States Patent [19]

Sakamaki et al.

[11] Patent Number: 4,601,647

[45] Date of Patent: Jul. 22, 1986

[54] HOLLOW ROTOR FOR MOVABLE VANE PUMPS AND THE LIKE AND METHOD OF MAKING THE SAME

[75] Inventors: Hiroshi Sakamaki, Tochigi; Susumu Sugishita; Yukio Horikoshi, both of Saitama, all of Japan

[73] Assignee: Nippon Piston Ring Co., Ltd., Tokyo, Japan

[21] Appl. No.: 571,186

[22] Filed: Jan. 16, 1984

[30] Foreign Application Priority Data

Jan. 18, 1983 [JP] Japan ..... 58-5324

[51] Int. Cl.[4] ..... F04C 2/00; F04C 18/00

[52] U.S. Cl. ..... 418/259; 29/156.8 R

[58] Field of Search ..... 418/259, 266–270, 418/91, 178, 179, 152; 29/156.8 R, 463, 564 R, 156.4 R; 228/250, 173 R, 173 C

[56] References Cited

U.S. PATENT DOCUMENTS

| | | | |
|---|---|---|---|
| 1,984,365 | 12/1934 | English | 418/266 |
| 2,326,194 | 10/1950 | Brauchler | 29/156.8 R |
| 2,705,459 | 4/1955 | Dunning | 418/267 |
| 2,753,428 | 7/1956 | Graham | 228/250 |
| 3,059,585 | 10/1962 | Froede | 29/156.8 R |
| 3,191,503 | 6/1965 | Fuehrer | 418/266 |
| 4,253,809 | 3/1981 | Ishizuka | 418/152 |

*Primary Examiner*—Leonard E. Smith
*Assistant Examiner*—Jane E. Obee
*Attorney, Agent, or Firm*—Birch, Stewart, Kolasch & Birch

[57] ABSTRACT

A hollow rotor for movable vane pumps and the like having a pair of right and left cup-shaped bodies each being separately shaped from steel or aluminum alloy in the form similar to either of axially bisected parts of a complete rotor. The right and left cup-shaped bodies have the respective open side faces abutted and joined to each other by butt resistance welding to be incorporated into the complete hollow rotor.

7 Claims, 2 Drawing Figures

HOLLOW ROTOR FOR MOVABLE VANE PUMPS AND THE LIKE AND METHOD OF MAKING THE SAME

BACKGROUND OF THE INVENTION

1. Field of the Invention

The present invention relates to a hollow rotor for a movable vane compressor and the like and to a method of making the same, and more particularly to a method suitable for mass-production of a hollow rotor having a somewhat complicated cross-section.

2. Description of the Prior Art

Movable vane compressors for use in vehicles are desired to be reduced in weight with a view toward providing economizing fuel consumption. The known movable vane compressor or motor is provided with a solid rotor which is the heaviest part of the compressor. This means that reduce the weight of a movable vane compressor or motor, it is reasonable to reduce the weight of the solid rotor or substitute a light weight hollow rotor for the heavy, solid one. However, the hollow rotor with a somewhat complicated cross-section is disadvantageously costly and difficult for quantity production because of being manufactured as one body by casting.

SUMMARY OF THE INVENTION

Thus it is an object of the present invention to provide a light weight hollow rotor that is easily producible.

Another object of the present invention is to provide a novel and improved method that allows mass production of a light weight hollow rotor used for movable vane compressors and the like.

BRIEF DESCRIPTION OF THE DRAWINGS

The present invention will become more fully understood from the detailed description given hereinbelow and the drawings which are given by way of illustration only, and thus are not limitative of the present invention, and wherein.

DETAILED DESCRIPTION OF THE INVENTION

In accordance with the present invention, the rotor for a movable vane compressor and the like comprises a pair of right and left cup-shaped bodies to be joined with each other as one body. Each of the right and left cup-shaped bodies is similar in shape to either of the axially bisected parts of the complete hollow rotor. The cup-shaped body is separately fabricated to have open and closed side faces, a shaft axially outwardly projecting from the closed side face, and a pluralilty of vane grooves radially or chordally recessed from the cylindrical periphery between the open and closed side faces. The right and left cup-shaped bodies have their open side faces axially abutted and welded so as to be incorporated into the aforementioned hollow rotor.

According to the present invention, the method of making the hollow rotor comprises the steps of separately shaping a pair of right and left cup-shaped bodies in the form similar to the bisected parts of a complete hollow rotor from a metallic material such as steel or aluminum alloy by forging or press-working, axially abutting and bonding the respective open side faces of the right and left cup-shaped bodies to each other by butt welding or butt resistance welding. The cup-shaped body and the shaft axially outwardly projecting from the closed side face of the cup-shaped body are integrally formed from the same material by forging. Otherwise, the shaft is welded to the closed side face of the cup-shaped body which is separately fabricated by press-working.

The present invention will now be described in detail below with reference to the drawings wherein like numbers are used in the various views to indicate identical elements.

Figure 1:
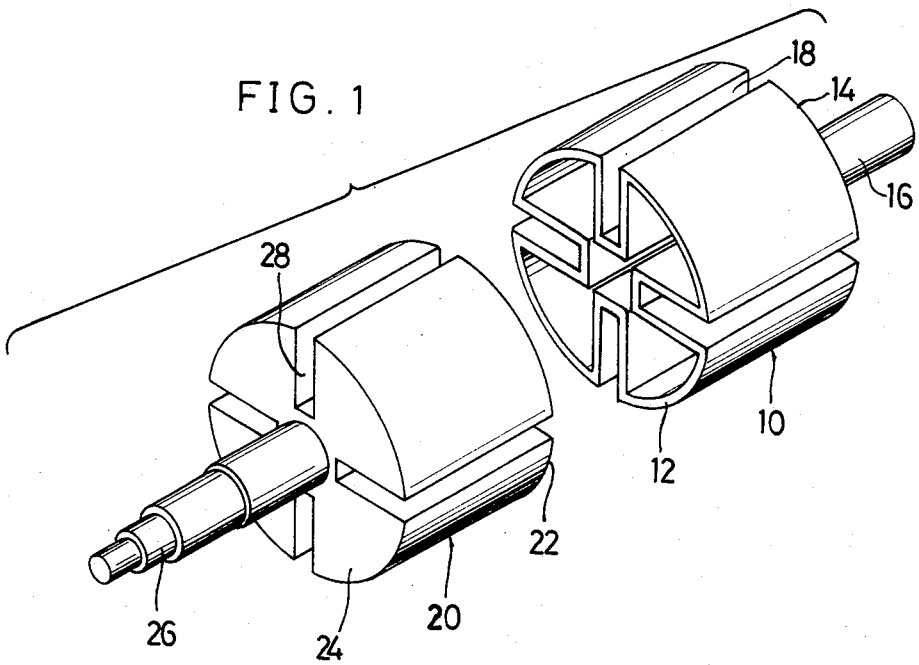
FIG. 1 is a pictorial view of a pair of right and left cup-shaped bodies to be joined with each other.
Figure 2:
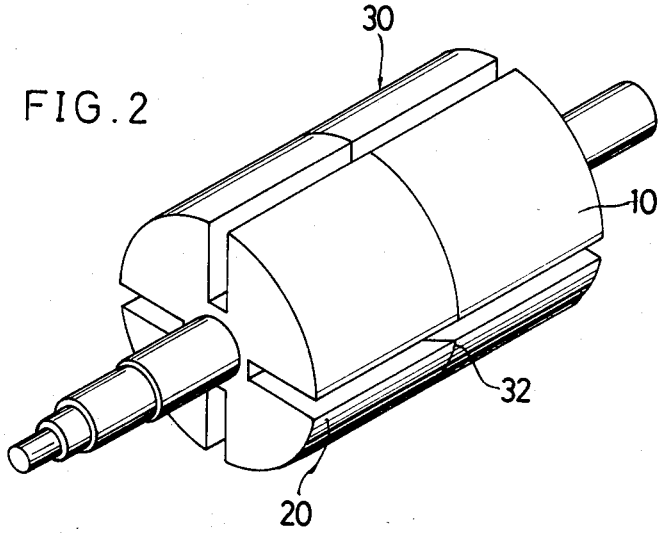
FIG. 2 is a pictorial view of a complete hollow rotor into which the cup-shaped bodies of FIG. 1 are incorporated.

Referring now to FIG. 1, a pair of right and left cup-shaped bodies 10, 20 are separately fabricated from a metallic material such as steel and aluminum alloy by forging. Each of the cup-shaped bodies 10, 20 is shaped in the form similar to either of axially bisected parts of the complete hollow rotor 30 as shown in FIG. 2. The cup-shaped body 10 as seen on the right hand of FIG. 1 has open and closed side faces 12, 14, a shaft 16 axially outwardly projecting from the closed side face 14, and a plurality of vane grooves 18 radially or chordally recessed from the cylindrical periphery between the open and closed side faces 12, 14. The cup-shaped body 20 as seen on the left hand of FIG. 1 has also open and closed side faces 22, 24, as shaft 26 axially outwardly projecting from the closed side face 24, and a plurality of vane grooves 28 radially inwardly recessed from the cylindrical periphery between the open and closed side faces 22, 24. The open side faces 12, 22 and vane grooves 18, 28 are axially alined with each other. The shafts 16, 26 are integrally formed with the respective bodies 12, 22 by forging. Otherwise, the shaft is welded to the closed side face of each cup-shaped body that is separately formed by press-working. Each of the right and left cup-shaped bodies 10, 20 is easily fabricated from steel or aluminum alloy by forging or press-working, though it has a somewhat complicated cross-section.

The right and left cup-shaped bodies 10, 20 are axially alined to have the respective open side faces abutted and joined to each other by butt resistance welding, so that they are incorporarted into the complete hollow rotor 30 with an annular welded portion 32 formed between the opposite open side faces, as seen in FIG. 2. The annular welded portion 32 is usually more resistible than the other portion. It is simple to bond the opposite open side faces of the right and left cup-shaped bodies 10, 20 to each other by butt welding or butt resistance welding. The hollow rotor 30, thus obtained, is remarkably light as compared with the known solid rotor and allows a good supply of light movable vane compressors and the like for use in vehicles, because the rotor has a single closed chamber defined by the cup-shaped bodies and uninterrupted by the right and left shaft members. The hollow rotor 30 is much more rigid than the known solid rotor having the same weight as the hollow rotor 30.

From the foregoing, it will be understood that, though the hollow rotor for movable vane compressors and the like has a somewhat complicated cross-section, it is efficiently mass-produced by the method of the present invention in which the right and left cup-shaped bodies in the form similar to the bisected parts of a complete hollow rotor are separately shaped from steel or aluminum alloy by forging or press-working and then axially abutted and joined to each other by butt resistance welding to be incorporated into a complete hollow rotor with the intervention of an annular welded portion between the opposite open side faces.

What is claimed is:

1. A hollow rotor for movable vane compressors and the like comprising a pair of right and left cup-shaped bodies having opposing open side faces and closed side faces, said open, opposing side faces thereof being annularly bonded to each other by a butt weld and right and left shaft members axially and outwardly projecting from the respective closed side faces of said right and left cup-shaped bodies, said cup-shaped bodies defining a closed chamber uninterrupted by said right and left shaft members.

2. A method of making a hollow rotor for movable vane compressors and the like comprising the steps of shaping a metallic material into right and left cup-shaped bodies in a form similar to the respective bisected parts of a hollow rotor, having opposing open faces and closed side faces, shaft members integrally formed with each of said closed side faces, abutting and bonding the respective open side faces of said right and left cup-shaped bodies by butt welding to define a closed chamber uninterrupted by said right and left shaft members.

3. The method of claim 2 wherein said material is steel.

4. The method of claim 2 wherein said material is an aluminum alloy.

5. The method of claim 2 wherein said right and left cup-shaped bodies are shaped by press-working and then fixed to said respective shafts which are separately shaped.

6. The method of claim 2 wherein said butt welding is butt resistance welding.

7. The method of claim 6 wherein said right and left cup-shaped bodies and said shafts are shaped by forging.

* * * * *